US007038583B2

(12) United States Patent
Costa et al.

(10) Patent No.: US 7,038,583 B2
(45) Date of Patent: May 2, 2006

(54) MODEM COMMUNICATOR

(75) Inventors: Hilario Costa, Sarasota, FL (US); Michael Slack, Sarasota, FL (US); Peter Montgomery, Owen Sound (CA); Douglas Price, Chatsworth (CA)

(73) Assignee: Edwards Systems Technology, Inc., Cheshire, CT (US)

( * ) Notice: Subject to any disclaimer, the term of this patent is extended or adjusted under 35 U.S.C. 154(b) by 752 days.

(21) Appl. No.: 09/947,536

(22) Filed: Sep. 7, 2001

(65) Prior Publication Data

US 2003/0030556 A1 Feb. 13, 2003

Related U.S. Application Data

(60) Provisional application No. 60/306,886, filed on Jul. 23, 2001.

(51) Int. Cl.
*G08B 1/00* (2006.01)

(52) U.S. Cl. ..... 340/531; 340/506; 340/533; 340/310.01; 340/310.06

(58) Field of Classification Search ..... 340/506, 340/531, 533, 310.01, 310.06
See application file for complete search history.

(56) References Cited

U.S. PATENT DOCUMENTS 6,650,238 B1 * 11/2003 Britton ..... 340/539.1

* cited by examiner

*Primary Examiner*—Daryl C Pope
(74) *Attorney, Agent, or Firm*—Baker & Hostetler LLP

(57) ABSTRACT

A single communication apparatus for alarm system control boxes that include the combination of a digital communicator and a remote communicating device. The communicating apparatus transmits status reports and events to a remote location. Remote login is permitted to access the control box through a external port or through the remote communication device.

22 Claims, 2 Drawing Sheets

MODEM COMMUNICATOR

PRIORITY

This application claims priority to the provisional U.S. patent application entitled, EST-3 Modem Communicator, filed Jul., 23, 2001, having a Ser. No. 60/306,886, the disclosure of which is hereby incorporated by reference.

FIELD OF THE INVENTION

The present invention relates generally to a plug-in device for alarm system control boxes. More particularly, the present invention relates to a single device that enables an alarm system control box to communicate with a remote location as well as allow remote locations to initiate contact with the system.

BACKGROUND OF THE INVENTION

In this day and age of computers, security and monitoring has become a multi-million dollar industry. Protection against theft, fire and other hazards has become a need or a requirement for many. From commercial buildings to the single family house owner, computerized systems have been installed to help combat these problems. There are smoke detectors, motion detectors, shatter sensors and so forth on the market to enable the owner of the property to protect against particular problems or threats. All of these devices connect to a central control box to where the controller of the system is located. The control box monitors all the detection devices and alerts the appropriate individual as to the problem.

An industry has even grown out of monitoring the control boxes. Most security companies have an off-site central monitoring system that is first alerted as to the occurrence of a problem. The owner usually pays a fee for the monitoring service. When an event occurs, the central monitoring system can alert the owner or send out the company's own people to investigate.

The current technology allows only a one way transmittal of data, from the system to the central monitoring station. Furthermore, the current state of the art lacks the combination of a digital communicator and a remote communicator merged into a single device. Both of these elements allow the control box to report the events as they happen and additionally allow remote users to access the system for any number of reasons. Therefore, there exists a need for a single device that can easily be inserted into an existing alarm control box that allows the system to communicate to remote locations as well as allow remote location to initiate contact with the system.

SUMMARY OF THE INVENTION

The foregoing needs have been satisfied to a great extent by the system and method of the present invention where in one aspect of the present invention is to provide an alarm system with a digital communicator and a remote communications device.

It is another aspect of the present invention to provide access to the alarm system to others from remote locations.

The above and other aspects are achieved through the use of a novel combination of a digital communicator and a remote communicator as herein disclosed. In accordance with one embodiment of the present invention, a plug-in for alarm systems is inserted into the control box. The plug-in is comprised of a digital communicator and a remote communication device. The digital communicator receives status updates from the alarm control box and then transmits these updates to a remote location.

In accordance with another embodiment of the present invention, the remote communication device permits remote access to the control box to gather data as well as update the system.

In accordance with another embodiment of the present invention, a method of communicating is comprised of receiving events, updates or data from an alarm control box. The data is then transmitted to a remote location such as a central monitoring station. Additionally, a remote login is permitted to allow a remote machine or user to access the alarm control box. The remote login can monitor the system as well as exchange data such as updating software or events. The remote login can be a modem connection or even a hardwire connection such as a external port.

There has thus been outlined, rather broadly, the more important features of the invention in order that the detailed description thereof that follows may be better understood, and in order that the present contribution to the art may be better appreciated. There are, of course, additional features of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein, as well as the abstract included, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF PREFERRED EMBODIMENTS OF THE INVENTION

A preferred embodiment of the present invention provides a plug-in device that is comprised of a combination of a digital communicator and a remote communications device. The plug-in is for use with alarm control boxes that send status updates or events to remote locations as well as to allow remote access to the control box through a number of ways. Updates or events in this context are synonymous.

Figure 1:
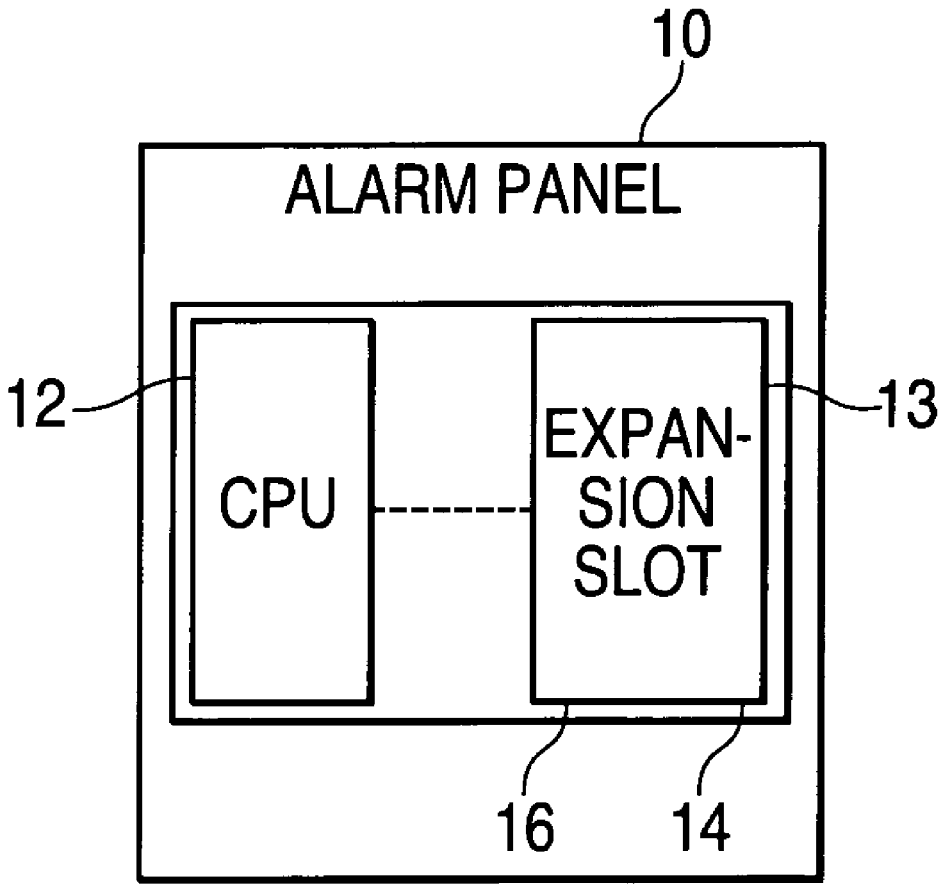
FIG. 1 is a block diagram of an alarm system in accordance with a preferred embodiment of the invention.

A preferred embodiment of the present inventive apparatus and method is illustrated in FIG. 1. The invention is contained within an alarm control box 10 such as a fire control box, burglary control box, etc . . . The control box 10 contains a central processing unit 12, which performs the monitoring of all the alarm devices. The alarm devices can be the motion detectors, temperature settings, smoke detectors and a whole host of other devices. All these devices connect through the alarm control box 10 to the central processing unit 12. In the preferred embodiment, the invention is linked to the central processing unit 12 via an expansion slot 13 in the alarm control box. The invention contains telephone jacks 14 that allow a plurality of telephone lines to connect to the control box 10. A serial port 16 is also provided so that a technician can communicate directly with the alarm.

An external computer is linked to the invention via the serial port 16. The serial port can be replaced by another type of port such as a parallel port, a universal serial bus (USB) port. In the preferred embodiment, the serial ports 16, 18 are an RS-232 and an RS-485 for both short and long distance communication. The only limitation is the ability to transfer data over a hard-wire connection.

When directly connected, the external computer downloads boot, application and configuration data and uploads configuration data. In most instances, the invention is configured with a list of account numbers with a corresponding receiver index, which include the two telephone numbers and their associated maximum attempts and protocol formats. Each entry in the account is given a numeric number and is called an account index (i.e. 1 to 255).

When configured by an external computer, the digital communicator is preloaded with at least two survival messages per receiver. The first message is a Central CommFail message, which will be automatically transmitted upon loss of communication with the central processing unit 12. The second message is a General Alarm message. This message is automatically transmitted when the common alarm is activated.

The invention communicates with the central processing unit 12 of the control box 10 as part of its main function. The operating firmware and configuration for the invention is downloaded in the field or at the alarm site via the serial port. Additional methods of downloading to the control box of the present invention will be readily apparent to those of ordinary skill in the art.

The download is performed when another machine, usually a computer, is directly connected to the central processing unit 12. The central processing unit 12 formats and sends event or update messages to the digital communicator, which in turn queues all pending events. In the preferred embodiment, the numerical priority of messages (highest priority, reserved for Fire alarms) ranges from one, the highest priority, usually reserved for fire alarms, to two-hundred and fifty-five the lowest priority. The two hundred and fifty-five priority code is usually reserved for self-generated dialer test messages.

The digital communicator receives status or event data directly from the central processing unit 12. After receiving the data, the data is processed and transmitted to a remote location. This location can be any number of possibilities. However, usually it is connected to a central monitoring station, which is operating 24 hours a day. To perform these tasks, the digital communicator is comprised of a dialer, protocol software, a processor and memory to enable it transmit the data to the central monitoring station.

One of the tasks in the digital communicator is to continuously search the transmit buffer for the oldest highest priority event. When the oldest highest priority event is found, the digital communicator looks up and dials the specified receiver. When the handshake is received, the invention reverts back to the buffer to search for the oldest highest priority event to this receiver and proceed to transmit this message to the receiver. If the message is acknowledged, the event is removed from the transmit buffer.

After the first message is acknowledged, a new search is performed for the next oldest highest priority event for this receiver and then that message is transmitted. The invention continues to transmit any message to this receiver by priority by age for a maximum of 60 seconds. One minute is used rather than a fixed number of events. The reason is that some formats are faster than others. Also the delay in transmitting is a higher priority event that is of concern.

At the end of the 60 second time period, the digital communicator checks for the oldest highest priority event to any receiver. If the oldest highest priority event needs to go to a different receiver, the digital communicator disconnects and dials that receiver. For 60 seconds, the invention transmits by priority and age, any message for that receiver. If at the end of the 60-second time period there is no older or higher priority event to a different receiver, then the invention continues to send message to the online receiver.

At this point, the digital communicator checks after each event for an older higher priority event to another receiver and disconnects and attempts to contact the receiver. This algorithm minimizes time consuming and costly receiver dialing and connect time but insures a maximum delay of 60 seconds for a high priority event to a different receiver.

In the event the digital communicator dials a telephone number and does not receive a handshake and is forced to hang up, the event queue is rechecked and the receiver of the oldest priority event is dialed. This may or may not be the telephone number/receiver of the first attempt. Separate individual counters are needed for each receiver index to keep track of the maximum attempts to any one receiver. Each attempt counter is cleared when an acknowledge is received or a new event for that receiver index is received when the attempt counter is at its maximum. Not resetting the attempt counter until the maximum attempt is reached prevents an unlimited number of attempts for a slowly changing input.

The following chart is an example of six events that are received quickly in the sequence. They are shown with the specified priority and the account index which point to the receiver index. The last column is the order in which they are transmitted. This assumes that three events are transmitted in sixty seconds.

| Sequence order received | Priority | Receiver Index | Transmit Order |
|---|---|---|---|
| 1 | Low | 1 | 3 |
| 2 | Low | 2 | 6 |
| 3 | Medium | 1 | 2 |
| 4 | Medium | 2 | 5 |
| 5 | High | 1 | 1 |
| 6 | High | 2 | 4 |

In the receiver index table, there is a maximum attempt parameter. This is the maximum number of times the invention attempts to call that receiver for a single event. An attempt is defined as going off hook to initiate a new call whether or not a dial tone, handshake or acknowledge was detected. In the preferred embodiment, each receiver in the index has its own retry counter and only the one specified individual counter is incremented when an attempt is made to reach that receiver.

When the digital communicator receives an event and fails to report the event, a delta event is generated to the central processing unit with Point xx Local Trouble Active "Dialer Failure to Communicate, where xx is the index of the account that failed. The central processing logs, displays and annunciates the trouble but should not be programmed to generate a new trouble message to the same receiver. A new trouble message to a different receiver may be programmed but is not required.

If at any point the invention looses communication with the central processing unit for greater than five minutes, then the invention transmits the Central Processing Unit (CPU) CommFail message, previously loaded, to all accounts having a receiver so programmed. If the invention detects, the common alarm line is active during a communication loss, it transmits the General Alarm message, previously loaded.

All messages received from the central processing unit 12 are reported when they are received. Any delay before transmission, for safety delays etc . . . are accomplished in the central processing unit 12 using a "Delay Feature".

A plurality of plug-in devices may be installed in a network. This allows simultaneous event transmissions. Any of the plug-ins in the network may have an active download at any one time. Depending on the type of session, it may only be possible to talk to one module at a time.

If trouble is detected on any of the telephone lines, the invention generates a local trouble pseudo point delta for the central processing unit 12. The central processing unit 12 is normally programmed to locally annunciate the trouble and give the invention back a Telco Line X Trouble" message. The invention uses a functioning line to report the message to the central monitoring station. When the invention detects that the line is OK, it will generate a local trouble restore pseudo for the line restoring.

To comply with the requirements of National Fire Protection Association (NFPA) and Underwriters Laboratories (UL), the plug-in insures at least one message is transmitted to the central monitoring station every twenty-four hours. This is to confirm that the alarm system is operational.

Each message sent to the digital communicator includes the priority of the message, telephone number(s) to be used to dial the receiver, the receiver format (i.e. SIA(Standard for Digital Communicators) and Telocator Alphanumeric Protocol (TAP)), the number of attempts and the message to be sent. To achieve dual reporting, rules are created to send two separate events to the invention. Each has a different telephone number(s), format and message. To achieve split reporting, rules are created to send one event to the digital communicator when one set of things happen and a different event when some other things happen. To achieve time reporting, rules are created to send one event to the invention when one set of things happen between one set of times and a different event when the same thing happens at a different set of times. Dual, split and time reporting can also be combined.

Figure 2:
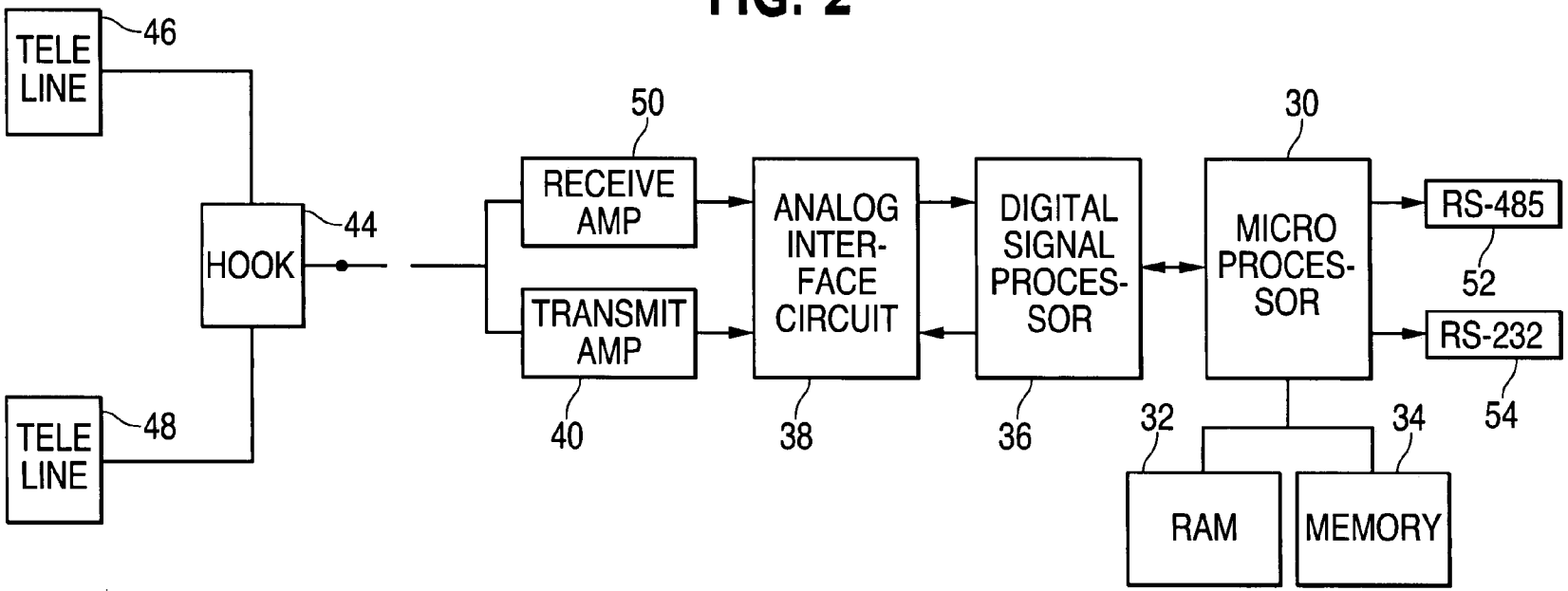
FIG. 2 is a block diagram of the invention.

When the invention has identified a pending event to be transmitted, one of the telephone lines is seized. This connects one of the incoming telephone lines to the hook switch and simultaneously disconnects all premises telephones attached to that line. When the line is seized, the hook switch opens which effectively hangs up on any going telephone call and prevents any premise telephone from interfering with the invention's efforts. After seizing the line, the invention remains on hook for a minimum of five seconds before attempting to go off hook A preferred embodiment of the present inventive apparatus and method is illustrated in FIG. 2. This figure is a block diagram of the invention. A microprocessor 30 is linked to static Random Access Memory (RAM) 32 and flash memory 34. In this RAM 32 and memory 34 resides key coding and the events or updates as reported by the central processing unit 12. The events are sent to the microprocessor to where the digital communicator processes the message. For reporting an event, the event is passed through a digital signal processor 36 to format the message as requested by the central processing unit 12. This event is then passed through an analog interface circuit 38 to enable the data to be transmitted. Afterwards it is passed to the transmit amp 40 through which it eventually travels to the telephone line 42. However, the invention must activate the hook switch 44 to seize either telephone line 46, 48.

In receiving an inbound call, the invention detects an incoming ring. It generates a local monitor active pseudo point delta for the central processing unit 12. The point may be used by the central processing unit 12 to display a ringing message, as an aid to the user in knowing when the line should be answered. Additionally, there is a manual command that is entered on the central processing unit 12 that causes the invention to answer an incoming call. This typically is used in very high security areas where dial in remote access does not provide adequate security. In this instance, the plug-in is programmed not to automatically answer an incoming ring.

The hook switch 44 directs the call to the receive amp 50 to where it is placed through the circuit 38, processor 36 and onto the microprocessor 30 to be analyzed. From here any number of actions can take place. The incoming call can check the status of the control box, upload software etc . . . The invention also contains a plurality of ports 52, 54 that enable connection for data transmission over long distances as well as short distances. In the preferred embodiment, the long distance port 52 is an RS-485 rail. The short distance port 54 is an RS-232 serial port.

Any standard personal computer or modem can initiate a download/upload session by calling the alarm control box. In response to the ring signal, the remote communicator initiates a training sequence and establishes a connection. In the preferred embodiment, the personal computer upon detecting the connection must respond with the Access Passcode (i.e. password). If the Access Passcode is valid, then the remote communicator transmits a positive acknowledgement. If the Access Passcode is not valid, then the remote communicator disconnects immediately. A negative acknowledgement is only transmitted when the Access Passcode was in error.

If a computer has called in to download or retrieve a status and has established a connection and the system receives am alarm, the invention will disconnect the computer, clear the telephone line and immediately place a call to the appropriate central station.

The many features and advantages of the invention are apparent from the detailed specification, and thus, it is intended by the appended claims to cover all such features and advantages of the invention which fall within the true spirits and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A communicating device for installation into a plurality of alarms control boxes, comprising:

a digital communicator configured to receive data originating from an alarm system and sending said data to a remote location; and a remote communicator configured to enable a remote login to said alarm system, said remote communicator permits the bi-directional transfer of data between the said alarm system and said remote login, said remote communicator is configured to permit a communications session to be initiated from more than one remote location in a network to which the alarm is linked, wherein the communications session is configured to permit alarm system data to be retrieved as well as software to be uploaded to the alarm system.

2. The communicating device of claim 1, wherein said remote location is a central monitoring system.

3. The communicating device of claim 1, wherein said remote communicator is a modem.

4. The communicating device of claim 1, further comprising:

an external port which enables communication with the alarm system to exchange information.

5. The communicating device of claim 4, wherein said external port is a serial port.

6. The communicating device of claim 4, wherein said external port is a parallel port.

7. The communicating device of claim 4, wherein said external port is a universal serial bus.

8. The communicating device of 4, wherein said external port is an RS-485 port.

9. The communicating device of claim 4, wherein said external port is an RS-232 port.

10. A method for communicating events for an alarm control boxe comprising:

transmitting data received from the alarm system to more than one remote location with a digital communicator;

accessing the alarm control box from the more than one remote location through a remote communicator;

upon accessing the alarm control box, retrieving data from the alarm control box through the remote communicator from the more than one location, wherein the data is related to the status of the alarm control box; and uploading software to the alarm control box through the remote communicator.

11. The method of communicating as in claim 10 wherein said remote communicator is a modem.

12. The method of communicating as in claim 11 wherein said remote communicator is an external port.

13. The method of communicating as in claim 12 wherein said external port is a serial port.

14. The method of communicating as in claim 12 wherein said external port is a universal serial bus.

15. The method of communicating as in claim 12 wherein said external port is a parallel port.

16. A communicating device for installation into a plurality of alarm control boxes comprising:

means for transmitting data received from the alarm system to more than one remote location;

means for accessing the alarm control box from the more than one remote location;

means for retrieving data from the alarm control box through the means for accessing from the more than one location, wherein the data is related to the status of the alarm control box; and means for uploading software to the alarm control box through the means for accessing.

17. The communicating device as in claim 16 wherein said means for transmitting is a digital communicator.

18. The communicating device as in claim 16 wherein said means for accessing is a modem.

19. The communicating device as in claim 16 wherein said means for accessing is an external port.

20. The communicating device as in claim 19 wherein said external port is selected form the group consisting of serial port, a parallel port and a universal serial bus.

21. The communicating device as in claim 19 wherein said external port is an RS-232 port.

22. The communicating device as in claim 19 wherein said external port is an RS-485 port.

* * * * *

UNITED STATES PATENT AND TRADEMARK OFFICE

CERTIFICATE OF CORRECTION

PATENT NO. : 7,038,583 B2
APPLICATION NO. : 09/947536
DATED : May 2, 2006
INVENTOR(S) : Hilario Costa et al.

It is certified that error appears in the above-identified patent and that said Letters Patent is hereby corrected as shown below:

Column 7
Line 30, please replace “boxe” with --box--”;

Column 8
Line 32, please replace “form” with --from--.

Signed and Sealed this

Twenty-second Day of August, 2006

JON W. DUDAS
*Director of the United States Patent and Trademark Office*